US009653845B2

(12) United States Patent
Ludwig et al.

(10) Patent No.: US 9,653,845 B2
(45) Date of Patent: May 16, 2017

(54) CONNECTOR ASSEMBLY WITH INTEGRATED LEVER LOCKING SYSTEM

(71) Applicant: Delphi Technologies, Inc., Troy, MI (US)

(72) Inventors: Martin Ludwig, Wuppertal (DE); Necdet Papurcu, Datteln (DE)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 15/029,128

(22) PCT Filed: Oct. 16, 2014

(86) PCT No.: PCT/EP2014/072264

§ 371 (c)(1),
(2) Date: Apr. 13, 2016

(87) PCT Pub. No.: WO2015/055787

PCT Pub. Date: Apr. 23, 2015

(65) Prior Publication Data

US 2016/0254618 A1 Sep. 1, 2016

(30) Foreign Application Priority Data

Oct. 16, 2013 (EP) ..... 13188960

(51) Int. Cl.
*H01R 13/629* (2006.01)
*H01R 13/64* (2006.01)

(52) U.S. Cl.
CPC . *H01R 13/62955* (2013.01); *H01R 13/62938* (2013.01); *H01R 13/64* (2013.01)

(58) Field of Classification Search
CPC ..... H01R 13/62955; H01R 13/62938; H01R 13/62933
USPC ..... 439/157, 680
See application file for complete search history.

(56) References Cited

U.S. PATENT DOCUMENTS 6,341,968 B1 * 1/2002 Grant ..... H01R 13/62938 439/157
7,238,050 B2 * 7/2007 Sakakura ..... H01R 9/032 439/157
8,517,756 B2 * 8/2013 Song ..... H01R 13/6271 439/357
8,662,906 B2 * 3/2014 Schmitt ..... H01R 13/6273 439/157
9,093,786 B2 * 7/2015 Forell ..... H01R 13/62938
9,178,307 B2 11/2015 Papurcu et al.
(Continued)

FOREIGN PATENT DOCUMENTS

WO 2007/098253 A2 8/2007
WO 2013060772 A1 5/2013

*Primary Examiner* — Gary Paumen
(74) *Attorney, Agent, or Firm* — Robert J. Myers

(57) ABSTRACT

An electrical connector assembly comprising a connector housing; and a mate assist mechanism comprising a lever pivotably arranged on the connector housing. The lever is movable from a preliminary mating position to a fully mated position, and is configured to be releasably held in the preliminary mating position by a holding means. The holding means comprises a locking protrusion and a corresponding locking reception receiving said locking protrusion when the lever is in the preliminary mating position.

13 Claims, 4 Drawing Sheets

(56) References Cited

U.S. PATENT DOCUMENTS

| | | | | |
|---|---|---|---|---|
| 2004/0097113 | A1* | 5/2004 | Shinozaki | H01R 13/62938 439/157 |
| 2004/0209503 | A1* | 10/2004 | Fukamachi | H01R 13/64 439/157 |
| 2006/0030186 | A1* | 2/2006 | Toyoda | H01R 13/62938 439/157 |
| 2006/0089031 | A1 | 4/2006 | Flowers et al. | |
| 2007/0099461 | A1* | 5/2007 | Pittenger | H01R 13/62955 439/157 |
| 2007/0207646 | A1* | 9/2007 | Tsuji | H01R 13/62927 439/157 |
| 2007/0287310 | A1* | 12/2007 | Dekoski | H01R 13/62938 439/157 |
| 2009/0042423 | A1* | 2/2009 | Shiga | H01R 13/62927 439/157 |
| 2009/0181566 | A1* | 7/2009 | Shibata | H01R 13/62938 439/157 |
| 2009/0203241 | A1* | 8/2009 | Matsumura | H01R 13/62938 439/157 |
| 2012/0115342 | A1 | 5/2012 | Schmitt et al. | |
| 2013/0252446 | A1 | 9/2013 | Forell et al. | |
| 2014/0134862 | A1* | 5/2014 | Itou | H01R 13/62944 439/157 |

* cited by examiner

CONNECTOR ASSEMBLY WITH INTEGRATED LEVER LOCKING SYSTEM

CROSS-REFERENCE TO RELATED APPLICATION

This application is a national stage application under 35 U.S.C. §371 of PCT Application Number PCT/EP2014/072264 having an international filing date of Oct. 16, 2014, which designated the United States, said PCT application claiming the benefit of priority under Article 8 of the Patent Cooperation Treaty to European Patent Application No. 13188960.2, having a filing date of Oct. 16, 2013, the entire disclosure of each of which are hereby incorporated herein by reference.

TECHNICAL FIELD OF THE INVENTION

The present invention relates to an electrical connector assembly comprising a mate assist lever, which can be locked in a preliminary mating position.

BACKGROUND OF THE INVENTION

In many fields of applications, in particular in the case of mass production assembly processes, it is important that electrical connectors can be connected easily and fast. In cases where connectors have a plurality of electrical contact terminals to be mated, as it is often the case in the field of automotive applications, it is common that the connectors are provided with mate assist mechanisms in the form of mate assist levers or sliders to facilitate mating of connector and counter connector (mating connector).

Such mate assist mechanisms usually are provided linearly movable or pivotably movable on a connector housing. Upon mating of the connector with a corresponding mating connector, the mate assist mechanisms are moved from a first, preliminary mating position, to a second, fully mated position, thereby facilitating the mating process.

A typical example of a lever mated connector assembly is for example described in WO 2007/098253. In this document, an electrical connector assembly comprising a mate assist lever, which serves to facilitate the mating of the connector assembly, is described. The mate assist lever is pivotably mounted to a first connector and can be moved from a preliminary mating position to a fully mated position. During this movement, a cam element provided on the pivotable lever engages a corresponding cam mechanism of the counter connector, whereby the two connectors are pulled towards each other upon movement of the lever. When moved into the final mated position, a portion of the lever snaps behind a latch member on the connector housing to lock the mate assist lever in the position, thereby also locking the mating of the two connectors.

A typical example of a connector assembly with a mate assist lever is further described in US 2006/0089031 A1. Similarly as in the case of the prior document discussed above, the mate assist lever disclosed in this document is provided pivotably on a connector housing and has generally a U-shaped form with two lever arms connected by common web. Each lever arm has a pivot axis that passes through the lever arm. The lever arms are provided such that, from the preliminary mating position, they can only be rotated into the fully mated position, but not in the opposite direction. However, with this prior art construction it is possible that the lever moves unintentionally or intentionally from the preliminary mating position to another position in the direction to the fully mated position, when no counter connector is present. In such a position different from the preliminary mating position, it is not possible to mate the two connectors, so that an operator has to manually displace the lever back into the preliminary mating position to start the mating process. This requires an additional working step that is undesirable.

BRIEF SUMMARY OF THE INVENTION

According to the invention, an electrical connector assembly is provided which comprises a connector housing and a mate assist mechanism comprising a lever pivotably arranged on or assigned to the connector housing. The lever is movable from a preliminary mating position to a fully mated position. In the preliminary mating position, it is possible to initiate a mating process of the connector housing with a corresponding mating connector. In the fully mated position, both connectors are fully mated with each other. As it is generally known in the art, by moving the lever from the preliminary mating position to the fully mated position, suitable cam means provided on lever, connector housing and/or mating connector interact with each other, to pull the two connector parts towards each other into a desired mating position. Furthermore, the connector assembly comprises holding means to releasably hold the lever in the preliminary mating position. In other words, the lever is held in the preliminary mating position, so that it does not unintentionally or intentionally move to a position, where it is not possible to initiate the mating process between the connector housing and a corresponding mating connector. This has the advantage, that the connector can be shipped to the customers with the lever in the preliminary mating position, so that upon assembly, in for example a vehicle, the operator does not have to align the lever into a position, which allows to initiate the mating process, but the lever is always in the correct position, i.e. the preliminary mating position. Thus, the connector housing can be inserted into a corresponding mating connector (or vice versa) and the mating process can be finished by rotating the lever into the fully mated position.

According to the present invention, the holding means comprise at least one locking protrusion and a corresponding locking reception receiving the locking protrusion when the lever is in the preliminary mating position. Furthermore, the locking protrusion may be arranged on the connector housing. To this end, the locking reception may be arranged on the lever and have first and second locking walls arranged on opposite sides of the locking protrusion, when the protrusion is received in the reception. Upon mating with a corresponding mating connector, the mating connector displaces the locking protrusion to release the lever. Thus, it is not possible to release the lever either intentionally or unintentionally when no corresponding mating connector is mated with the connector housing. In other words, the holding means allows only a release of the lever when a corresponding mating connector is mated with the connector housing. This has the further advantage that it is clear to the operator that, when he can move the lever, i.e. the lever is released, the mating parts are mated correctly.

To provide the desired holding functionality of the locking protrusion, the locking protrusion advantageously is an L-shaped hook that is configured to engage behind one of the first and second locking walls of the locking reception. Such an L-shaped hook provides a solid and firm holding of the lever when engaged behind one of the first and second locking walls of the locking reception.

A variant of an L-shaped hook is a T-shaped hook that allows engaging behind both of first and second locking walls of the locking reception, thereby providing a firm and solid holding of the lever.

The locking protrusion may comprise an inclined surface facing the mating direction, which inclined surface of the locking protrusion facilitates the displacement of the locking protrusion by the mating connector. Such an arrangement allows a very controlled and smooth displacement of the locking protrusion, thereby avoiding any restraints in the mating, displacement or advantageously the unmating process, respectively. Alternatively, the inclined surface may be arranged in addition in any other direction or a combination of directions, e.g. the locking protrusion comprises an inclined surface on all four sides.

The lever may have a U-shaped form with two lever arms connected by a common web. A U-shaped form means that the two lever arms are arranged parallel to each other and extend in the same direction when seen from the common web. Furthermore, the connector housing comprises peripheral walls and the lever arms are arranged adjacent to the inner sides of the peripheral walls. By arranging the lever arms adjacent to the inner side of the peripheral walls of the connector housing, the movement of the lever is assured, because the movement cannot be blocked by any parts outside the connector housing. In other words, the movement of the lever is protected by the peripheral walls of the connector housing from being blocked or being damaged.

The lever may be pivotable around a pivot axis perpendicular to the mating direction, when released.

The locking reception may be configured such that the contact surfaces of the first or second locking walls with the locking protrusion are oriented in a plane parallel to the mating direction and parallel to the pivot axis of the lever. The orientation of the contact surfaces provides a simple and strong means for securing a firm holding and correct holding position of the lever.

The connector housing may comprise four peripheral walls, wherein the mating connector comprises mating walls that are configured to fit between the peripheral walls. The peripheral walls respectively the mating walls may be arranged perpendicular to at least another peripheral wall respectively mating wall and are therefore arranged such that a simple and strong means for securing the correct orientation and fitting of the mating parts is achieved.

The connector housing may comprise a mating face and at least two guiding grooves that are formed on the mating face and that are arranged to interact with corresponding guiding projections of the mating connector. The guiding grooves and projections are advantageously arranged such that they are compatible with common corresponding mating parts. Thereby, a firm mating of the corresponding parts is ensured, it is advantageously prevented to mate non-corresponding parts and the correct orientation of the mating parts to each other is ensured.

The lever may further comprise cam grooves and the mating connector may comprise cam followers that are configured to interact with the cam grooves. The provision of cam grooves and corresponding cam followers ensures a firm and correct mating of the corresponding mating parts and ensures advantageously a strong locking position when the lever is moved into the fully mated position.

The locking protrusion may be displaced by the corresponding cam follower of the mating connector, thereby releasing the lever. Thus, the lever is only released when the mating connector is in the correct (initial) mating position with the connector housing. In other words, the connector housing and the mating connector are physically interacting and can be pushed towards each other to the final mating position by means of the lever action: when the two corresponding connector parts are mated with each other, the cam followers of the mating connector displace the at least one locking protrusion of the connector housing. Thus, the lever is only released when a release is functionally necessary, and an operator wants to finalize the mating by moving the lever from the preliminary mating position to the fully mated position. Consequently, it is prevented that the lever is released intentionally or unintentionally during transport or shipment. This holding means has the further advantage that it is a compact and light construction that can be easily injection molded.

At least one, and possibly both, lever arm(s) comprise(s) the locking reception, wherein the first and second locking walls are arranged on opposite sides of the pivot axis when in the preliminary mating position as seen in mating direction.

Two locking protrusions corresponding to the two locking receptions may be arranged each on opposite peripheral walls of the connector housing. This arrangement of two protrusions on opposite peripheral walls provides a particularly advantageous arrangement that prevents an overstressing of a single locking protrusion by distributing the stress applied thereon among two locking protrusions, when the lever is not released, but moved. Furthermore, it is possible to symmetrically release the lever on opposite peripheral walls, which advantageously enables a smooth and correct mating process.

The holding means may comprise at least four locking protrusions and four corresponding locking receptions. This further improves the durability of the holding means by preventing an overstressing of a single locking protrusion or two locking protrusions by distributing the stress applied thereon among four locking protrusions due to an application of force on the unreleased lever. Furthermore, it is possible to symmetrically release the lever on opposite peripheral walls, which advantageously further improves the mating process to be smooth and correct.

The electrical connector assembly may comprise a corresponding mating connector.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

It is therefore an object of the present invention to provide an electrical connector assembly with a mate assist lever of robust and simple construction, whereby it is secured, that the lever stays in the preliminary mating position and thus neither unintentionally nor intentionally moves out of this preliminary mating position when no counter connector is present. It is further an object of the present invention, to achieve these advantages with an inexpensive product, which can be produced by injection molding.

Figure 1:
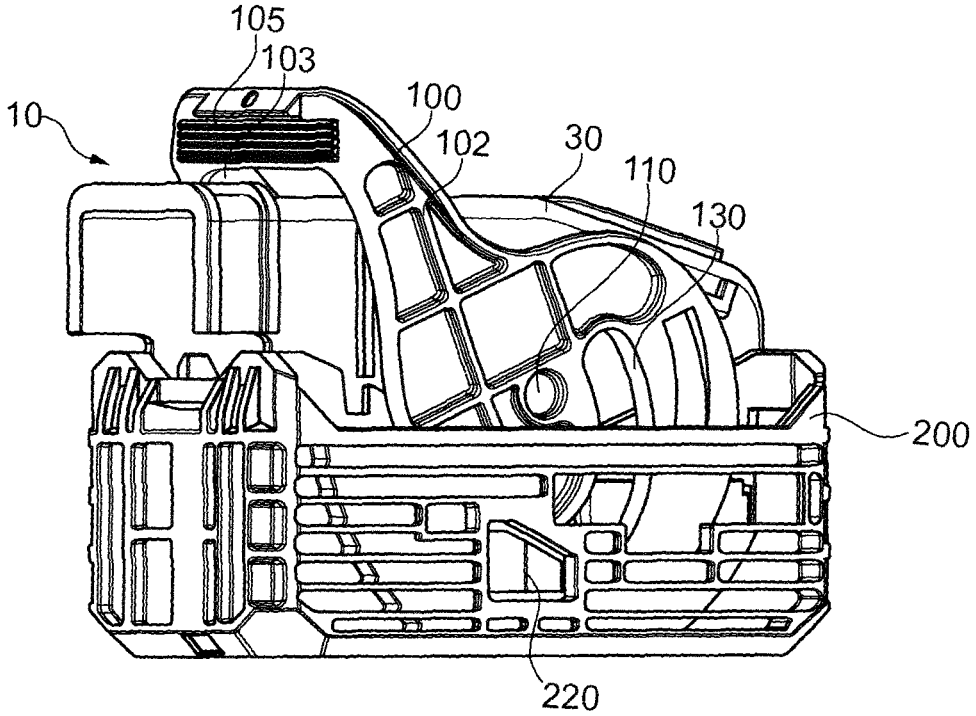
FIG. 1 shows a connector assembly in a three dimensional schematic view in assembled condition.

FIG. 1 shows a connector assembly 10 in a three dimensional schematic view in assembled condition. The connector assembly 10 comprises a lever 100, a connector housing 200 and a wire shroud 30 which forms a part of connector housing 200. The lever 100 is pivotably arranged on the connector housing 200 and is configured to be pivotable around a pivot axis 110. The lever 100 has a general U-shape configuration with two parallel lever arms 102, 103 connected by a common web 105, which extends perpendicular to the arms. In the shown embodiment each lever arm 102, 103 is symmetrical to the other and has a pivot axis 110 that passes through the lever arm 102. The lever 100 serves to facilitate a mating process between the connector housing 200 and a corresponding mating connector 300. The working principle of such mate assist mechanisms is generally well known to the skilled person, as from e.g. the prior art discussed above, so that it is refrained herein from giving a more detailed explanation thereof. The connector housing 200 comprises a latch wing 220 that comprises a locking protrusion 222 (see FIG. 2). In the position shown in FIGS. 1 and 2, the lever 100 is in the preliminary mating position, since the entrance to cam grooves 130 is aligned such that a cam follower of a mating connector 300 can enter the grooves (see FIG. 6).

Figure 2:
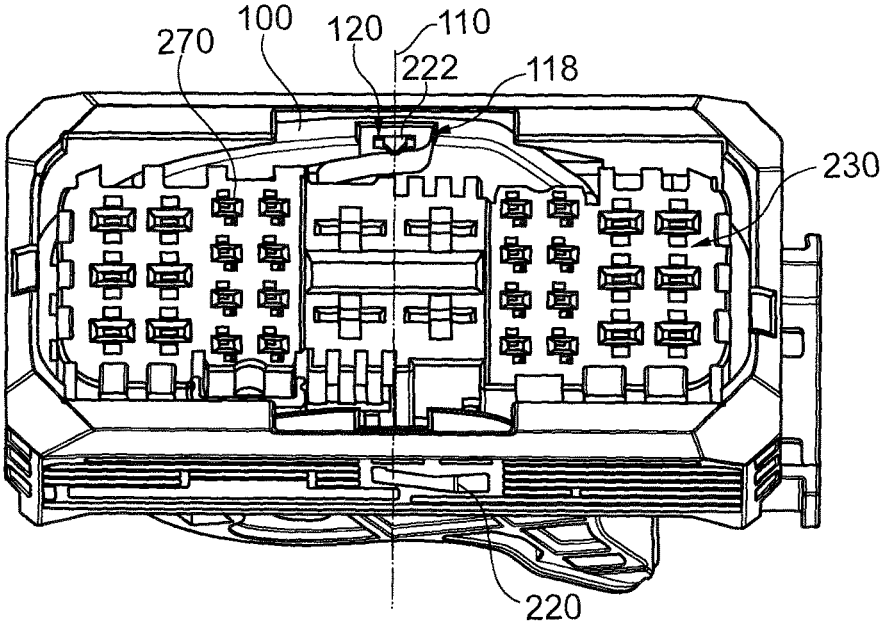
FIG. 2 shows the connector assembly of FIG. 1 in a bottom view.

FIG. 2 shows the connector assembly 10 of FIG. 1 in a bottom view, i.e. as seen in mating direction. In the shown embodiment, the connector housing 200 comprises a mating face 230 that comprises pin receptions 270 and that is configured to interact with a corresponding mating face 230 of a corresponding mating connector 300. The connector housing 200 further comprises a locking protrusion 222 that is arranged on the latch wing 220. However, it is to be noted that the locking protrusion 222 can also be arranged on another part of the connector housing 200. The lever 100 comprises a locking reception 120 that receives the locking protrusion 222 when the lever 100 is in the preliminary mating position. The first 122 and second 124 locking walls (see also FIG. 3) are arranged on opposite sides of the pivot axis 110 in the shown preliminary mating position as seen in mating direction. The lever 100 further comprises two cam grooves 130 that are respectively arranged in each of the lever arms 102, 103. As can be seen from FIG. 2, the dashed line shows a pivot axis 110, around which the lever 100 is pivotable.

Figure 3:
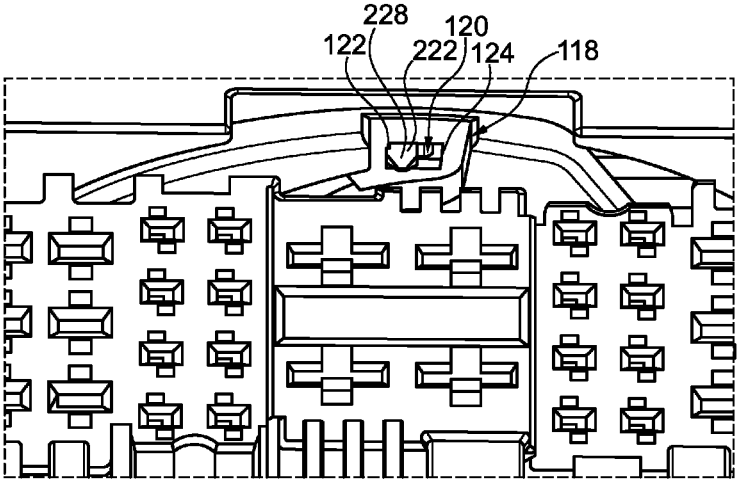
FIGS. 3 and 4 show details of the holding means.

FIG. 3 shows details of the holding means 118. In the embodiment shown, the locking protrusion 222 is arranged on the connector housing 200 and is received by the locking reception 120 that is arranged in the lever arm 102, 103 respectively when the lever 100 is in the preliminary mating position. The locking reception 120 comprises a first locking wall 122 and a second locking wall 124 that are arranged on opposite sides of the locking protrusion 222. In the embodiment shown, the locking protrusion 222 comprises an inclined surface 228 that faces the mating direction, wherein the inclined surface 228 of the locking protrusion 222 facilitates the displacement of the locking protrusion 222 by the corresponding mating connector 300. The locking protrusions 222, 223 extend into the respective entrances to the cam grooves 130 of the lever arms 102, 103.

Figure 4:
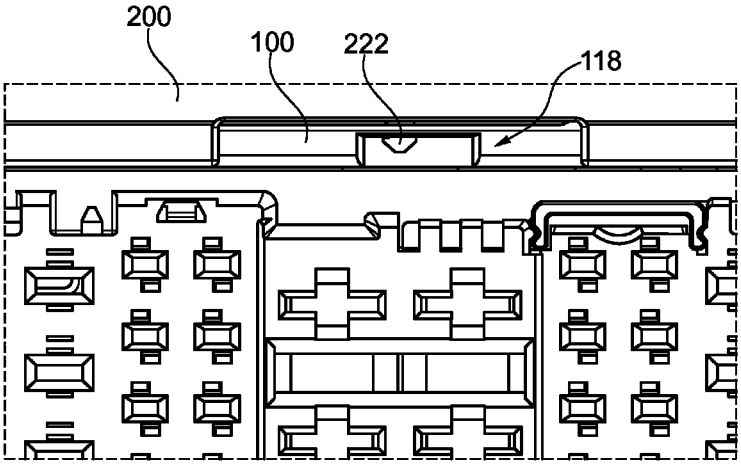

FIG. 4 shows further details of the holding means in a two-dimensional view of the holding means. The locking protrusion 222 is an L-shaped hook that is configured to engage behind the first locking wall 122 of the locking reception 120. However, it is to be understood that the locking protrusion 222 can alternatively be arranged such that it engages behind the second locking wall 124 of the locking reception 120. The person skilled in the art will understand that it is further possible that the locking protrusion 222 is a T-shaped hook that is configured to engage behind one of the first and the second locking walls 122, 124 of the locking reception 120. It is to be understood that the T-shaped hook is a specific embodiment of the L-shaped hook. The holding means 118 is configured to releasably hold the lever 100 in the preliminary mating position. It is to be understood that any number of locking protrusions can be arranged on the connector housing 200.

Figure 5:
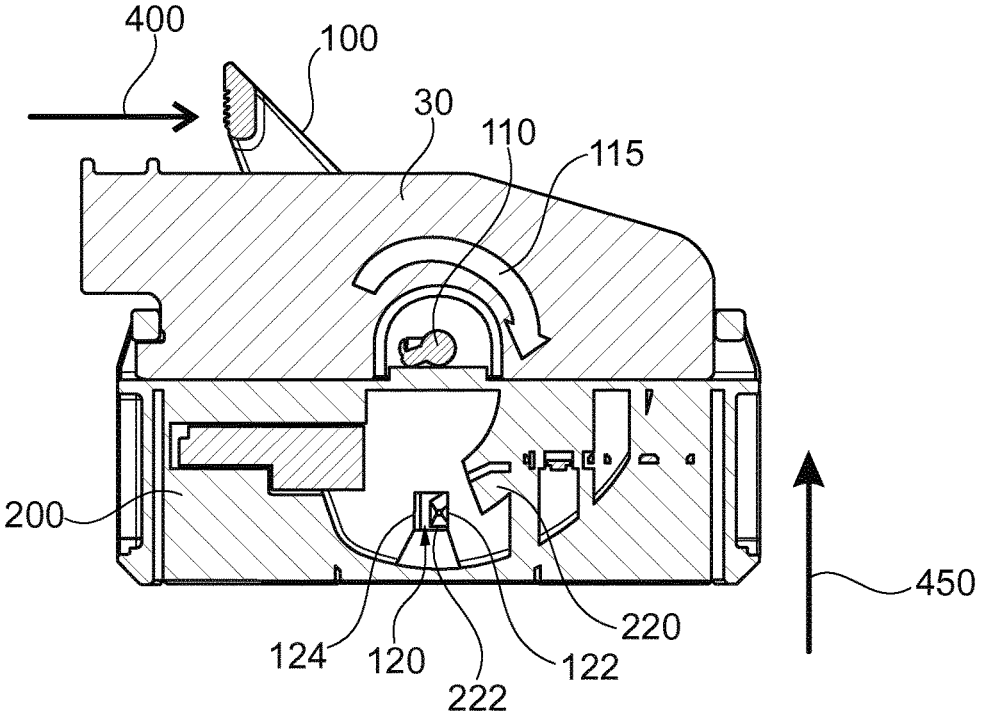
FIG. 5 shows a schematic cut side view of the connector assembly in accordance with the invention.

FIG. 5 shows a cut side view of the connector assembly 10. In the embodiment shown, the lever 100 is in the preliminary mating position. As can also be seen from FIGS. 1 to 4, the connector assembly 10 comprises symmetrically arranged identical holding means 118. In the embodiment shown in FIG. 5, the arrow 400 referred to as "force" indicates the application of a force component in the direction of the arrow 400. When released, upon the connector housing 200 being mated with a corresponding mating connector 300, the lever 100 that is in the preliminary mating position is movable upon application of the force as indicated in FIG. 5, in the rotational direction 115 around the pivot axis 110. However, due to the fact that the connector housing 200 is not mated with a corresponding mating connector 300 in the embodiment shown, as indicated by the circular arrow in FIG. 5, the lever 100 cannot be moved around the pivot axis 110, because the holding means 118, i.e. the locking protrusions 222, 223 and the corresponding locking receptions 120 hold the lever 100 in the preliminary mating position. Thus, it is neither intentionally nor unintentionally possible to move the lever 100 into the fully mated position or to another position than the preliminary mating position when no corresponding mating connector 300 is present. Furthermore, as can be seen from FIG. 5, the arrow 450 indicates a mating direction.

Figure 6:
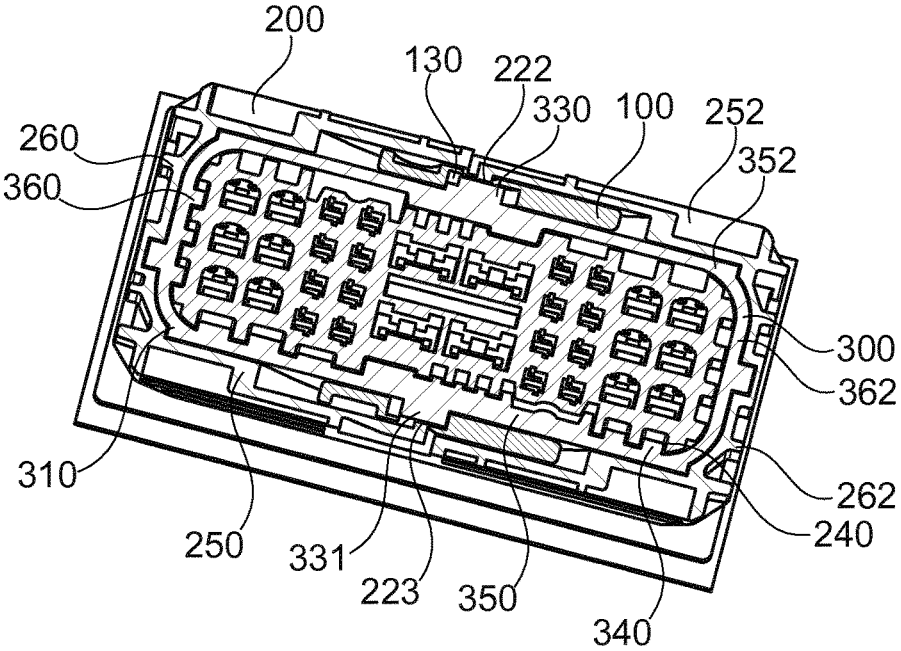
FIG. 6 shows a cut view of the connector assembly in mating position.

FIG. 6 shows a cut bottom view of the connector assembly 10 in mating position in accordance with the invention. The mating connector 300 comprises a mating connector housing 310 and two cam followers in form of cam bolts 330, 331 being arranged and protruding from two opposite mating walls 350, 352 (outer walls) of mating connector 300. When mated, as shown in FIG. 6, the corresponding mating connector 300, the cam bolts 330, 331 displace the locking protrusions 222, 223 of the connector housing 200, thereby releasing the lever 100. Although not clearly visible in FIG. 6, the skilled person will recognize that thereby the locking protrusions will be moved or deflected outwardly out of engagement with locking reception 120. In the mating process the inclined surface 228 that faces the mating direction of the locking protrusion 222 interacts with the cam bolts 330, thereby facilitating the displacement of the locking protrusion 222 by the corresponding mating connector 300. The skilled person will recognize that the corresponding cam bolt 331 displaces the locking protrusion 223, which can comprise an identical inclined surface 228 as locking protrusion 222, in a similar way. Upon mating of the corresponding mating connector 300 with the connector housing 200 and the displacement of the locking protrusions 222, 223, the lever 100 is now free to be pivoted around the pivot axis 110 perpendicular to the mating direction. In the embodiment shown in FIG. 6, one can also see that the guiding grooves 240 of the connector housing 200 are formed on the mating face 230 of the connector housing 200 and are arranged to interact with corresponding guiding projections 340 of the mating connector 300. The cam bolts 330 of the mating connector 300 are configured to interact with the cam grooves 130 of the lever 100 as shown in FIG. 2.

Figure 7:
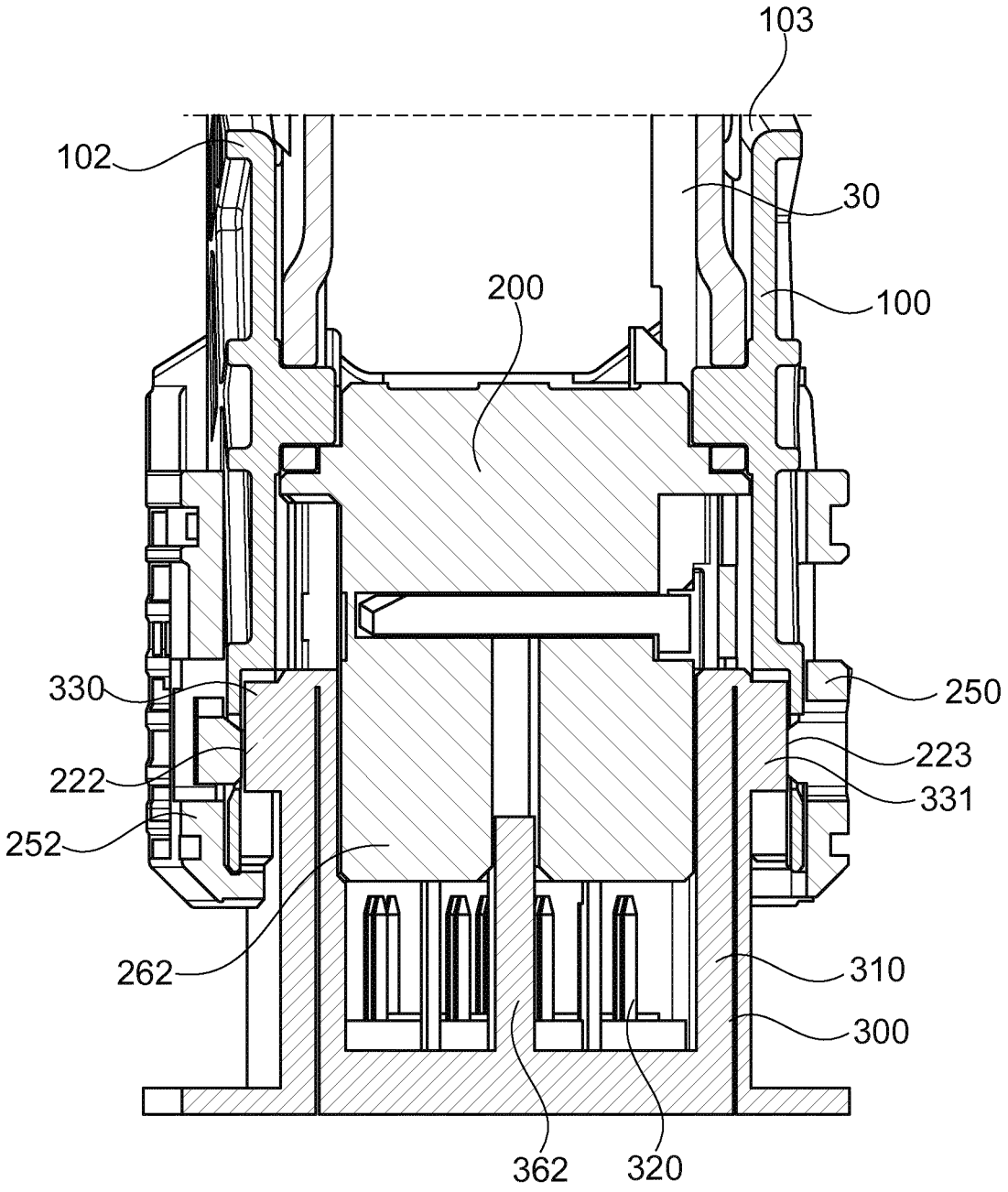
FIG. 7 shows a schematic cut front view of the connector assembly in mating position in accordance with the invention.

FIG. 7 shows a cut front view of the connector assembly 10 in mating position. The mating connector 300 further comprises mating connector pins 320 that are configured to interact with corresponding pin receptions 270 arranged on the mating face 230 (see e.g. FIG. 2) for establishing an electrical connection when the connectors are in mated position. The cam bolts 330 of the corresponding mating connector 300 displace the locking protrusion 222, 223 of the connector housing 200 to such an extent, that thereby the lever 100 is released. Furthermore, the lever arms 102, 103 are arranged adjacent to the inner sides of the peripheral walls 250, 252, 260, 262 and the mating connector 300 comprises mating walls 350, 352, 360, 362 that are configured to fit between the corresponding peripheral walls 250, 252, 260, 262 of the connector housing 200, as also indicated in FIG. 6. In the position shown in FIG. 7, it is now possible to move the lever 100 from the preliminary mating position to the fully mated position. As the skilled person recognizes, upon turning the lever 100 clockwise (as seen in FIG. 1) from the preliminary mating position to the fully mated position, the cam means 130, 330 provided on the lever 100 and the mating connector 300 interact so that the connector housing 200 and the mating connector 300 are pulled towards each other to achieve a full mating of the connectors.

By the concept of displacing the locking protrusion 222 by the cam bolts 330 of the mating connector 300 it is assured that the lever 100 can only be released, when the connector housing 200 is in the correct initial mating position with the corresponding mating connector 300; in other words when the cam followers are arranged in the entrances of the cam grooves 130. Thus, the rotation or movement of the lever 100 is only allowed, when the rotation or movement of the lever 100 is necessary, i.e. in the mating process. Moreover, an improved displacement of the locking protrusion 222, 223 can be achieved by the advantageous form of the locking protrusion 222, 223, e.g. by the inclined surface 228 of the locking protrusion 222, 223 facing the mating direction. It is advantageously prevented that, e.g. during transport or shipment of the connector assembly 10, the lever 100 is displaced unintentionally or intentionally when no corresponding mating connector 300 is present and it is prevented that an additional working step has to be provided to bring the lever 100 back into the preliminary mating position as it is necessary with the prior art connector assemblies.

The skilled person will recognize that the connector assembly 10 can be used and is used in practice in any spatial orientation, so that the expressions clockwise, up, down, left or right as used herein are only used to facilitate the description of the different elements of the connector assembly 10 shown in the figures.

LIST OF REFERENCE NUMERALS

10 connector assembly
30 wire shroud
100 lever
102 lever arm
103 lever arm
105 common web
110 pivot axis
115 rotational direction
118 holding means
120 locking reception
122 first locking wall
124 second locking wall
130 cam groove
200 connector housing
220 latch wing
222 locking protrusion
223 locking protrusion
228 inclined surface
230 mating face
240 guiding grooves
250 peripheral wall
252 peripheral wall
260 peripheral wall
262 peripheral wall
270 pin receptions
300 corresponding mating connector
310 mating connector housing
320 mating connector pins
330 cam bolt
331 cam bolt
340 guiding projections
350 mating wall
352 mating wall
360 mating wall
362 mating wall
400 arrow indicating a force application
450 arrow indicating the mating direction

We claim:

1. An electrical connector assembly, comprising:

a connector housing;

a mate assist mechanism comprising a lever pivotably arranged on the connector housing, the lever being movable from a preliminary mating position to a fully mated position; and a holding means to releasably hold the lever in the preliminary mating position, wherein said holding means further comprises a locking protrusion and a corresponding locking reception receiving said locking protrusion when the lever is in the preliminary mating position, wherein the locking protrusion is arranged on the connector housing, wherein the locking reception is arranged on the lever and has first and second locking walls being arranged on opposite sides of said locking protrusion, wherein the corresponding mating connector displaces the locking protrusion to release the lever upon mating with a corresponding mating connector, and wherein the locking protrusion is either an L-shaped or T-shaped hook configured to engage behind one of the first and second locking walls of the locking reception.

2. The electrical connector assembly according to claim 1, wherein the locking protrusion comprises an inclined surface facing the mating direction, which inclined surface of the locking protrusion facilitates a displacement of the locking protrusion by the corresponding mating connector.

3. The electrical connector assembly according to claim 1, wherein the lever has a U-shape form with two lever arms connected by a common web, wherein the connector housing comprises peripheral walls, and said two lever arms are arranged adjacent to inner sides of the peripheral walls.

4. The electrical connector assembly according to claim 1, wherein, when released, the lever is pivotable around a pivot axis perpendicular to the mating direction.

5. The electrical connector assembly according to claim 4, wherein the locking reception is configured such that contact surfaces of the first or second locking walls with the locking protrusion are oriented in a plane parallel to the mating direction and parallel to the pivot axis of the lever.

6. The electrical connector assembly according claim 3, further comprising four peripheral walls, wherein the corresponding mating connector comprises mating walls that are configured to fit between said peripheral walls.

7. The electrical connector assembly according to claim 1, wherein the connector housing comprises a mating face and at least two guiding grooves that are formed on the mating face and that are arranged to interact with corresponding guiding projections of the corresponding mating connector.

8. The electrical connector assembly according to claim 4, wherein the lever further comprises cam grooves and the corresponding mating connector comprises cam followers that are configured to interact with said cam grooves.

9. The electrical connector assembly according to claim 8, wherein the locking protrusion is displaced by the cam followers of the corresponding mating connector, thereby releasing the lever.

10. The electrical connector assembly according to claim 9, wherein at least one lever arm comprises said locking reception, wherein said first and second locking walls are arranged on opposite sides of the pivot axis when in the preliminary mating position as seen in mating direction.

11. The electrical connector assembly according to claim 1, wherein two locking protrusions corresponding to two locking receptions are arranged each on opposite peripheral walls of the connector housing.

12. The electrical connector assembly according to claim 1, wherein the holding means comprises at least four locking protrusions and four corresponding locking receptions.

13. The electrical connector assembly according to claim 1, further comprising the corresponding mating connector.

* * * * *